US005092244A

United States Patent [19]

Giglia

[11] Patent Number: 5,092,244

[45] Date of Patent: Mar. 3, 1992

[54] RADAR- AND INFRARED-DETECTABLE STRUCTURAL SIMULATION DECOY

[75] Inventor: Robert D. Giglia, Rye, N.Y.

[73] Assignee: American Cyanamid Company, Stamford, Conn.

[21] Appl. No.: 629,860

[22] Filed: Jul. 11, 1984

[51] Int. Cl.[5] ..... H01Q 15/20

[52] U.S. Cl. ..... 102/293; 89/1.11; 342/10

[58] Field of Search ..... 102/293, 355, 336, 342, 102/505; 89/1.11; 343/18 E; 342/8-10

[56] References Cited

U.S. PATENT DOCUMENTS

| | | | |
|---|---|---|---|
| 3,204,239 | 8/1965 | Young | 343/18 E |
| 3,837,281 | 9/1974 | Shaffer et al. | 102/336 |
| 4,069,762 | 1/1978 | Maury | 89/1.11 |
| 4,171,669 | 10/1979 | Allen | 102/342 |
| 4,222,306 | 9/1980 | Maury | 102/505 |
| 4,307,665 | 12/1981 | Block et al. | 102/505 |
| 4,454,816 | 6/1984 | Billard et al. | 102/342 |

*Primary Examiner*—Charles T. Jordan
*Attorney, Agent, or Firm*—Steven H. Flynn

[57] ABSTRACT

A simulation decoy whose position and structural purport are determinable by infrared detection means is disclosed, which comprises a multi-dimensional display body containing a sufficient quantity of combustible carbon to provide a controlled burning for a predetermined length of time, and means to initiate ignition of said carbon to produce sustained burning of said multi-dimensional display body, to activate such simulation decoy for infrared detection. The simulation decoy of this invention may employ metal coated fibers with the combustible carbon to provide radar-detection capability and may be utilized to mimic motive structures such as land-based vehicles, marine vehicles, or aircraft, as a two-dimensional or three-dimensional display, providing an infrared and radar signature useful as a defensive countermeasure in warfare or other battlefield conditions. In one embodiment, the multi-dimensional display body is provided as an inflatable spherical body which can be discharged from an aircraft at high altitudes and employed to provide a spherical radar and infrared signature, to provide a defense countermeasure against "smart" heat-seeking, surface-to-air and air-to-air guided missiles.

22 Claims, 4 Drawing Sheets

RADAR- AND INFRARED-DETECTABLE STRUCTURAL SIMULATION DECOY

BACKGROUND OF THE INVENTION

1. Field of the Invention

This invention relates generally to simulation decoys useful in infrared-, and in radar- and infrared-detection environments. More specifically, the invention relates to military defensive countermeasure systems, having utility as decoys for aircraft, ships, tanks, and other military targets under battlefield or warfare conditions.

2. Description of the Prior Art

In the practice of modern warfare, a variety of missiles have come into use which employ sensing means, such as radar and/or infrared detection means to determine the position and structure of potential targets, e.g., land-based vehicles, ships, and aircraft. Examples of such missiles include the "Sidewinder" heat-seeking missile, employed in air-to-air combat and the more recently developed French Exocet missile, which is radar-guided. The Exocet missile was used successfully in the Falklands war between Argentina and Great Britain as an anti-ship missile.

With regard to infrared-sensing devices employed in such missiles, it has been common practice to employ various decoy means, which burn or otherwise emit infrared radiation in use, such means being launched or otherwise deployed to provide a positional and structural perception by the detection means of an intended target. Such decoys provide means for aircraft, land-based vehicles, or ships to elude the infrared-guided weapons.

Decoy systems of the aforementioned type are disclosed in U.S. Pat. No. 4,222,306 (a multiple decoy-launching unit), U.S. Pat. No. 4,307,665 (same), U.S. Pat. No. 4,171,669 (a decoy flare cartridge containing a charge of jelled hydrocarbon fuel), French Patent No. 2,490,333 (a projectile containing explosives, such as material producing a flare or an infrared decoy), and U.S. Pat. No. 4,069,762 (an emissive decoy comprising an ignitable pyrotechnic composition, the ignition of which forms a cloud of droplets of aerosol from a liquid aerosol in a separate compartment of the decoy). Great Britain Patent No. 2,121,148 discloses a guided missile radar decoy comprising a metal-coated balloon which is inflated by compressed air, it being taught that several such balloons coupled together produce a reflection similar to that of a ship. Specifically, the balloons may be set up in "V" configuration to simulate a ship and decoy radar-guided missiles.

A particular problem with infrared decoys of the prior art (e.g., parachute or projectile flares) is that modern infrared detection means have become sufficiently accurate insofar as their resolution characteristics are concerned to differentiate as "phony" these previously effective decoys. Such infrared detection means as currently employed can differentiate a 1% change in temperature and thus can accurately resolve and differentiate such decoy means from the temperature and size profile of the actual target—a jet engine or missile exhaust, or a tank and its occupants. True and accurate thermal profiles of the actual target can be programmed in the control apparatus of the missile such that its infrared detection means "look" for the programmed thermal structure, e.g., of an engine block and cooling system network in a tank, and thus are not confused by conventional infrared decoy displays.

Accordingly, there is a continuing need in the field of military countermeasures for a simulation decoy which can accurately mimic the thermal structure of an intended target and thus foil the aforementioned high-resolution infrared detection means. In addition, because such infrared detection means are frequently coupled with radar detection means or used as an adjunct to an initial radar sighting which then is subjected to IR scanning to determine the precise nature of the radar detection, there is likewise a need for an improved infrared decoy of the aforementioned type which likewise accurately simulates the radar signature of an intended target.

It therefore is an object of the present invention to provide an improved simulation decoy whose position and structural purport (i.e., what the structure appears to be) are determinable by infrared detection means.

It is a further object of the present invention to provide an improved simulation decoy of the above type, whose position and structural purport are determinable by radar, either alone or in combination with infrared detection means.

SUMMARY OF THE INVENTION

This invention relates to a simulation decoy whose position and structural purport are determinable by infrared detection means comprising:

(a) a multi-dimensional display body formed of fabric containing combustible activated carbon in the form of fibers or particles, such combustible activated carbon being present in the fabric in an amount and with a surface area sufficient to permit sustained burning of said fabric for a predetermined time; and (b) means to initiate ignition of said combustible activated carbon in said multi-dimensional display body fabric for sustained burning of said multi-dimensional display body, whereby said simulation decoy is activated for infrared detection.

In a preferred embodiment, the fabric in the multi-dimensional display body comprises a composite material selected from the group consisting of:

(i) activated carbon fibers having a BET surface area in the range of from about 250 to about 1,000 meters$^2$/gram, reinforced with a reinforcingly effective amount of a non-ignitable binder fiber;

(ii) particulate carbon of diameter in the range of from about 10 $\mu$m to about 500 $\mu$m encapsulated in a matrix of non-ignitable binder fibers; and (iii) mixtures of (i) and (ii).

The aforementioned non-ignitable binder fibers may suitably comprise a low surface area carbon or preoxidized carbon, i.e., a carbon or preoxidized carbon having a BET surface area substantially less than about 250 m$^2$/g. Other non-ignitable binder fibers such as NOMEX® and KEVLAR® also may be used.

To impart radar simulation decoy characteristics to the aforementioned multi-dimensional display body, it may be useful in some instances to provide a metallic constituent in the fabric or matrix, such as by a metal coating disposed on the surface of the carbon fibers or particles.

In one particularily preferred embodiment, the means to produce sustained burning of said multi-dimensional display body comprise a source of oxygen-containing gas and a combustion catalyst providing for the initiation of ignition of the combustible carbon, upon exposure thereof to ambient conditions.

DETAILED DESCRIPTION OF THE PREFERRED EMBODIMENTS

Figure 1:
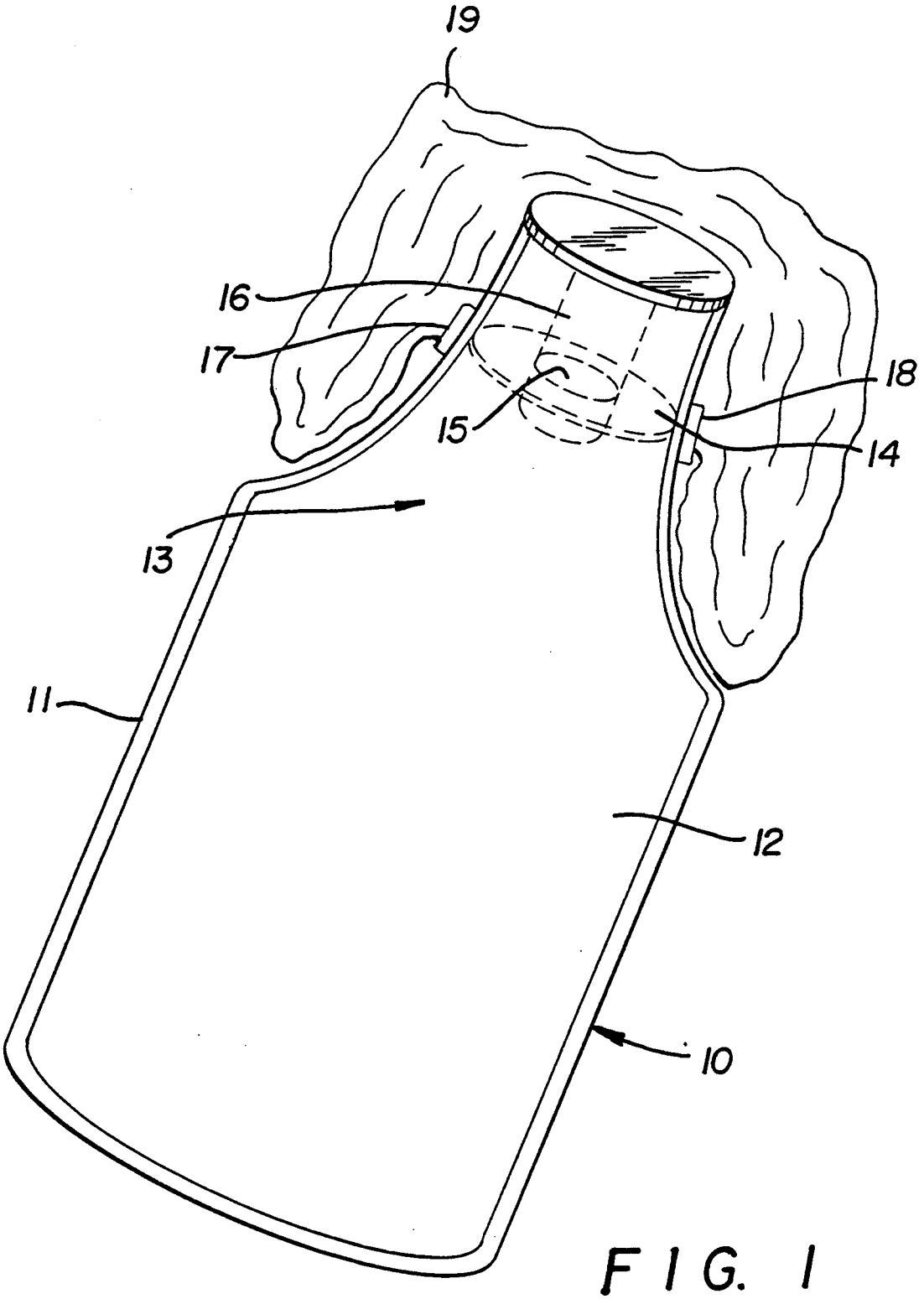
FIG. 1 is an infrared decoy according to the present invention, in the form of an inflatable balloon-like structure featuring an oxygen-containing gas supply means which may be employed to provide a spherical display for infrared, or infrared and radar detection.

The simulation decoy of the present invention comprises a multi-dimensional display body formed of an ignitable fabric of controllable burning characteristic, the fabric comprising sufficient content of combustible carbon to provide the desired infrared "signature." As used herein, the term "multi-dimensional" in reference to the display body indicates that the display body provides a two- or three-dimensional depiction whose position and structural purport are determinable by infrared detection means. Suitably, the carbon content of the fabric may be constituted by activated carbon fibers of high surface area, e.g., in the range of from about 250 to about 1,000 $m^2/g$ in a structural matrix which comprises a reinforcingly effective amount of a non-ignitable (non-combustible) binder fiber, to provide the activated carbon fiber matrix with sufficient mechanical strength to retain its structural integrity during use. Alternatively, or in addition to the aforementioned high surface area activated carbon fibers, the carbon content of the ignitable fabric may be constituted by particulate activated carbon having a diameter in the range of from about 10 $\mu$m to about 500 $\mu$m. The carbon particles may be encapsulated in a matrix of non-ignitable binder fibers or other structural matrix material, again to provide sufficient strength and mechanical integrity for use conditions.

In order to impart radar signature characteristics to the multi-dimensional display body described above, it is advantageous to provide a metal coating of a suitable radar-reflective metal (e.g., nickel, copper or iron, with nickel generally being preferred) on carbon fibers, activated carbon particles, and/or reinforcing binder fibers employed in the ignitable fabric. It is advantageous to provide such metal coated fibers, when fibers are employed as the form of the carbon, in differing lengths to provide strong reflection of radar signals. For example, it may be advantageous to provide metal coated carbon fibers of diameter in the range of from about 4 $\mu$m to about 40 $\mu$m and length in the range of from about 1 mm to about 30 mm with fibers of such length comprising preferrably between about 10% and 40% by weight, based on the weight of the fabric in which such metal-coated fibers are deployed.

The ignitable and combustible carbon fiber or carbon particle employed as the combustible carbon component of the fabric in the multi-dimensional display body should have a surface area preferrably greater than 250 $m^2/g$, e.g., in the range of from about 250 to about 1,000 $m^2/g$. Below the lower limit of about 250 $m^2/g$, there is too little surface area provided for effective combustion in use, and above about 1,000 $m^2/g$, the strength of the carbon fiber or particle is reduced, and the decoy becomes significantly more expensive, without corresponding level of improvement in the performance of the decoy.

Where carbon fibers are employed as the morphology for the combustible carbon component of the fabric for the multi-dimensional display body, the fibers may be employed in woven or non-woven matrices, in which it generally is desirable to employ a binder fiber which is non-combustible in character, for retention of the structural integrity of the fiber matrix and fabric forming the display body during its use. A suitable binder fiber may comprise carbon fibers of low surface area (carbonized carbon fiber) having a BET surface area of less than about 25 $m^2/g$. Also suitable for use as reinforcing binder fibers are fibrillated polytetrafluoroethylene, KEVLAR® and NOMEX® fibers.

In some applications of the present invention, it may be necessary or desirable to provide for initiation of ignition of the combustible carbon constituent in the display body by incorporation of a catalyst component in the fabric matrix. Thus, oxidation catalyst materials, such as chromium, silver, copper, and iron, may be deposited or otherwise coated on the combustible carbon surface to facilitate burning of the fabric. Generally, the loading levels for the metallic catalyst will range from about ½ weight percent to about 5 weight percent, based on the weight of the combustible carbon coated with the metal. The metal catalyst may be applied to the substrate carbon by any conventionally employed means, such as liquid phase precipitation, vapor phase precipitation, liquid phase deposition, and vapor phase deposition. It is preferred in practice to employ a liquid phase deposition of the salt of the metal catalyst, followed by thermal decomposition of the salt to yield the metal in a reduced state and for such purpose the thermal decomposition step is suitably carried out under a reducing atmosphere. Nonetheless, the specific method employed to deposit the metal on the carbon substrate forms no part of the present invention, and any suitable method known to those of ordinary skill in the art may be usefully employed.

As mentioned, the combustible carbon content of the fabric employed in the simulation decoy of the present invention will usefully lie in the range of from about 50% to about 85% by weight, based on the weight of the fabric. At levels below 50% by weight, insufficient combustible carbon is provided with the result that the utility life of the decoy is unsuitably short. On the other hand, at weight percent levels above 85% combustible carbon, the physical character of the decoy is adversely affected, since insufficient reinforcement or other material is provided to maintain the structural integrity of the decoy.

The decoy of the present invention may be fabricated in a manner to provide either a two-dimensional or a three-dimensional infrared and/or radar signature.

Referring now to the drawings, FIG. 1 shows a cross-sectional perspective view of a simulation decoy according to one embodiment of the present invention. In this embodiment, the simulation decoy 10 comprises a gas container vessel 11 whose lower portion defines a gas enclosure space 12 filled with a compressed oxygen-containing gas for support of combustion of the carbon-containing decoy fabric as hereinafter more fully described. The upper portion of the container 10 features a neck construction 13 in which is disposed a rupture disc 14 having an orifice 15 which is closed to gas communication with the exterior of the container by a rupture pin 16. Joined to the rupture pin 16 is a collapsed spherical balloon-like envelope 19 formed of fabric comprising a woven carbon fiber fabric in a matrix with reinforcing binder fibers of "pre-ox" carbon fibers. The balloon-like envelope 19 is secured at its upper extremity to the rupture pin 16 and at its lower end to the outer surface of the neck of container 11, by means of the circumferentially applied adhesive joint 17, 18.

Figure 2:
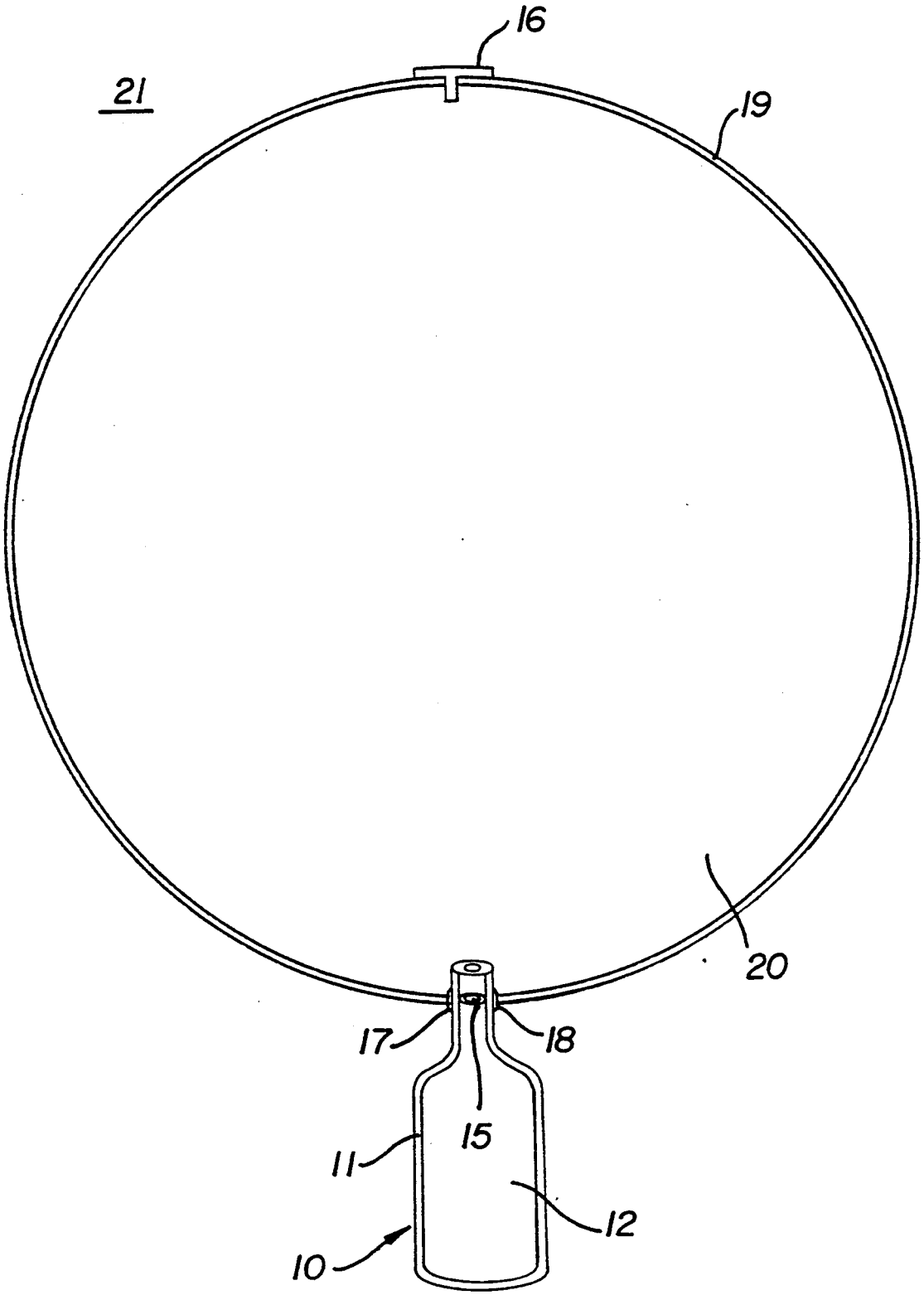
FIG. 2 shows the simulation decoy of FIG. 1, in an inflated state.

In operation, the decoy 10 is ejected or launched from suitable launching means, as for example from a conventional rocket launcher of an aircraft. The impact of launching (or alternatively, if the decoy is launched at high altitude, by operation of pressure differential between the interior of the container and the exterior atmosphere) results in rupture of the rupture disc 14 and release of the rupture pin 16 from the orifice 15 of the rupture disc. As a result of such rupture, the gas, at a pressure in the container 11 sufficient to inflate the balloon-like envelope 19, flows into the interior of the envelope 19 and inflates same to the configuration shown in FIG. 2. In FIG. 2, all parts and elements are numbered correspondingly with respect to the same parts in FIG. 1. The pressure differential between the interior 20 of the carbon fabric envelope 19 and the ambient pressure conditions of the external environment 21 is selected to provide for complete inflation of the envelope 19. The envelope 19 is designed with sufficient porosity to provide for diffusion and/or slow convection of gas outwardly through the fabric envelope to provide an oxygen-containing gas (if none is present in the exterior environment 21) at the envelope's exterior surface to support combustion of the envelope at a predetermined controllable sustained rate.

The composition of the gas contained in container 11 may be varied to provide a relatively faster or relatively slower rate of burning of the envelope 19 as may be desired or necessary in a given application. For example, it may be to advantage to employ a hydrocarbonaceous vapor in the oxygen-containing gas, to accelerate the rate of burning of the envelope 19 which otherwise would occur in the absence of such hydrocarbonaceous constituent. Alternatively, dilutents, such as helium, argon, nitrogen, or xenon may be employed to produce a relatively slower rate of burning, to prolong the combustion life of the decoy. In this respect, it may be of advantage to utilize helium as a constituent gas in the envelope interior space 20, to provide for buoyancy of the decoy and positioning of same in a relatively stable locus in the atmosphere.

In summary, the character of the contained gas may be varied to increase or decrease the rate of combustion, which also may be varied by the thickness and woven or non-woven character of the envelope 19, as well as the envelope's specific composition. Further, the weight of the container 11 may be varied to produce a greater or lesser rate of descent when the decoy is launched in the atmosphere.

Figure 3:
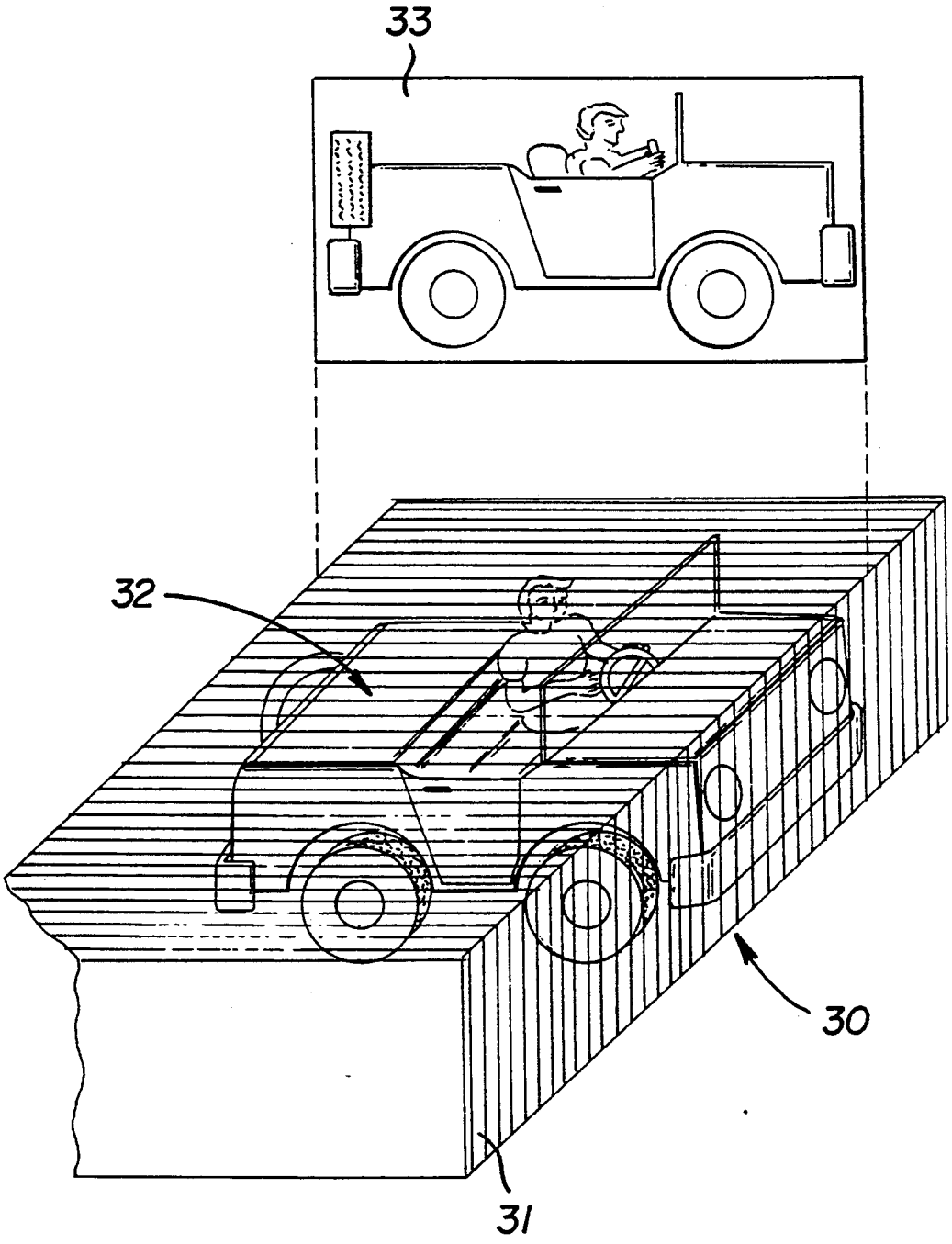
FIG. 3 is a perspective view of a laminated display body, which is activatable to provide an infrared simulation of a Jeep vehicle.

FIG. 3 shows a three-dimensional display body 30, which is composed of various sequential laminae 31, of which ply 33 is shown in greater detail to indicate the infrared signature (two-dimensional on the respective plies) of a simulated vehicle (Jeep) 32, which is provided (in three dimensions) by the laminated body. Thus, each ply of the laminate is provided with a coating of combustible carbon in the shape of a longitudinal cross-section of the Jeep 32, with the combustibility of the carbon being varied, as e.g. by provision of greater or lesser surface area in the carbon signature "picture" to provide thermal differentials across the plane of the picture, in order to simulate the temperature differentials which would be encountered by thermal sensing using infrared means of an actual Jeep vehicle (i.e., with hot spots being provided in the engine, coolant system, and exhaust train, so as to mimic exactly the infrared thermogram which would be generated by sensing an actual operating vehicle, including the thermographic characteristics of a human driver and any other occupants of such vehicle). Accordingly, when the display body 30 is actuated by igniting and combusting the combustible carbon-containing "picture," the burning display body will provide an accurate depiction of a vehicle and its driver. The combustible carbon may be ignited as in the prior embodiment by forming the signature picture of carbon fibers or particles in matrix comprising a binder fiber reinforcing component, wherein the carbon fibers or particles are coated with a metallic oxidation catalyst which initiates ignition upon exposure of the display body 30 to the ambient atmosphere.

Figure 4:
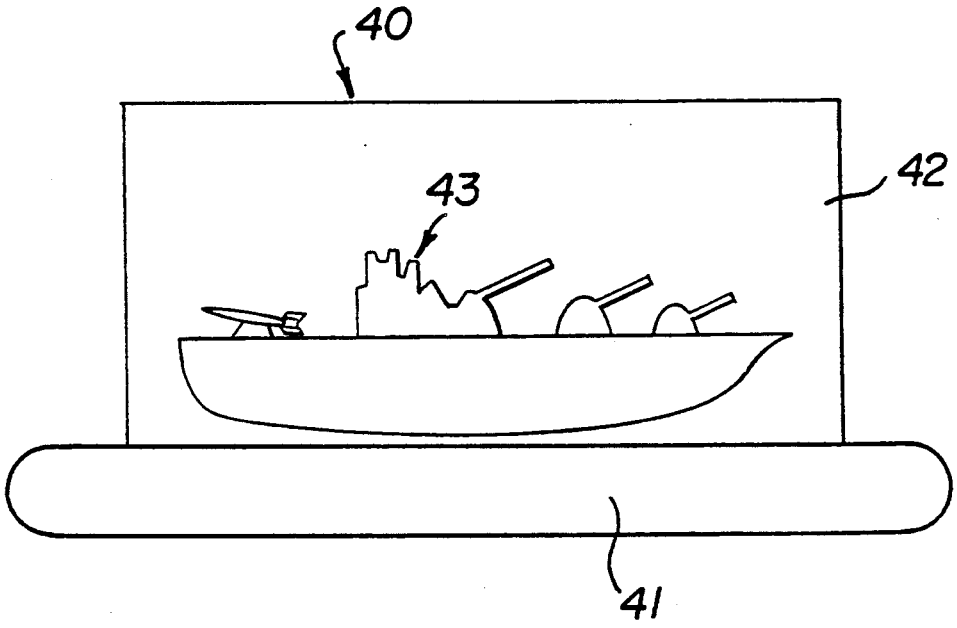
FIG. 4 is a two-dimensional display body providing a radar and infrared signature of a sea vessel.

FIG. 4 is a further embodiment of the invention, wherein a signature picture of a ship 43 is depicted on a planar display board 42 and the display body is mounted on pontoon members 41 to provide an assembly 40 which is capable of being floated in water to provide a signature detectable by radar and infrared scanning means. The display picture of the ship 43 again may be comprised of a fabric of the appropriate outline shape mounted on the display board, with the fabric comprising activated carbon fibers of high surface area coated with a metallic oxidation catalyst as a means to initiate ignition and combustion of the carbon fibers and including metal plated carbon fibers, to provide a radar and infrared signature for the decoy assembly.

Although the means disclosed in connection with the above-discussed preferred embodiments to initiate ignition and combustion of the carbon component of the fabric has included a metallic oxidation catalyst coating on the carbon fibers or particles, it will be appreciated that other means may be employed to initiate ignition and combustion of the carbon constituent, such as direct blow-torch or flame-thrower application of heat to the display body, or the provision of strongly exothermic chemical reaction means to provide localized heat input to the carbon particle or carbon fiber display, etc. In like manner, various geometries and configurations of the display will suggest themselves to those skilled in the art. Accordingly, all such modifications and variants of the invention are fully intended as being within the scope of the present invention.

What is claimed is:

1. A simulation decoy whose position and structural purport are determinable by infrared detection means, comprising:

(a) a multi-dimensional display body formed of a fabric containing combustible activated carbon in the form of fibers or particles, said combustible activated carbon being present in the fabric in an amount and with a surface area sufficient to permit sustained burning of said fabric for a predetermined time; and (b) means to initiate ignition of said combustible activated carbon in said multi-dimensional display body fabric for sustained burning of said display body, whereby said simulation decoy is activated for infrared detection.

2. A simulation decoy according to claim 1, wherein said fabric contains a sufficient quantity of a metallic constituent to provide a positional signature detectable by radar detection means.

3. A simulation decoy according to claim 2, wherein said metallic constitutent is deposited on the surface of fibers in said fabric.

4. A simulation decoy according to claim 1, wherein said fabric containing combustible activated carbon in the form of fibers or particles comprises a composite material selected from the group consisting of:

(a) activated carbon fibers having a BET surface area in the range of from about 250 to about 1,000 $m^2/g$, reinforced with a reinforcingly effective amount of a non-ignitable binder fiber; and (b) particulate carbon of diameter in the range of from about 10 μm to about 500 μm, encapsulated in a matrix of non-ignitable binder fibers; and (c) mixtures of (a) and (b).

5. A simulation decoy according to claim 4, wherein the combustible activated carbon content in said composite material of said fabric is in the range of from about 50% to about 85% by weight, based on the weight of said composite material.

6. A simulation decoy according to claim 1, wherein said means to initiate ignition of said combustible activated carbon in said multi-dimensional display body fabric comprise a coating of metallic combustion catalyst on the surface of said combustible activated carbon fibers or particles, at a sufficient loading thereon to induce burning of said fabric at ambient temperature in the presence of oxygen.

7. A simulation decoy according to claim 6, wherein said metallic combustion catalyst comprises a metal selected from the group consisting of chromium, silver, copper, and iron.

8. A simulation decoy according to claim 7, wherein the loading of metallic combustion catalyst is at least ½% up to 5% by weight, based on the weight of the combustible activated carbon fiber or particle substrate.

9. A simulation decoy according to claim 7, wherein said metallic combustion catalyst has been loaded on said combustible activated carbon fiber or particle substrate by liquid phase deposition of a metal salt on said substrate from a salt solution of the metal, followed by thermal decomposition of the metal salt under reducing conditions to yield a metal coating on said substrate in a reduced pure metallic state.

10. A simulation decoy according to claim 1, wherein said fabric has a combustible activated carbon content of between 50% and 85% by weight, based on the weight of the fabric.

11. A simulation decoy according to claim 1, comprising a sufficient quantity of metal-coated fibers in said fabric to provide a radar signature detectable by radar detection means, wherein said multi-dimensional display body has a radar- and infrared-detection signature in a geometric shape depictive of a motive structure.

12. A simulation decoy according to claim 11, wherein said multi-dimensional display body depicts a two-dimensional vehicular structure.

13. A simulation decoy according to claim 11, wherein said multi-dimensional display body depicts a three-dimensional vehicular structure.

14. A simulation decoy according to claim 11, wherein said motive structure is selected from the group consisting of tanks, trucks, ships and aircraft.

15. A simulation decoy according to claim 1, wherein said multi-dimensional display body is in the form of a collapsed spherical body enclosed by said fabric, and wherein said means (b) to initiate ignition of said combustible activated carbon for sustained burning of said multi-dimensional display body comprise a container (i) in latent gas flow communication with the interior of said collapsed spherical body, (ii) closed by closure means rupturable by impact or pressure differential to provide gas flow communication between said container and said interior of said collapsed spherical body, and (iii) containing a gas having an oxygen content of from about 20% to about 100% by volume, said means (b) further comprising a metallic combustion catalyst deposited on said combustible activated carbon in said fabric; whereby upon impact or pressure differential conditions, said rupturable closure means are ruptured to initiate gas flow comunication between said container and said interior of said collapsed spherical body to cause inflation of said collapsed spherical body to a fully inflated configuration, and the oxygen-containing gas introduced into the interior of the inflated spherical body provides a combustion support medium for sustained burning of said combustible activated carbon which is catalytically initiated by said metallic combustion catalyst upon contact of said combustible activated carbon with the oxygen-containing gas.

16. A simulation decoy according to claim 15, wherein the oxygen-containing gas comprises a mixture of oxygen and a second gas component selected from the group consisting of helium, nitrogen, argon, and xenon, and mixtures thereof.

17. A simulation decoy according to claim 15, wherein the oxygen-containing gas is a mixture of oxygen and helium, whereby said multi-dimensional display body may be inflated in the atmosphere at high altitude and maintained at such high altitute for an extended time.

18. A simulation decoy whose position and structural purport are determinable by radar and infrared detection means, comprising (a) a multi-dimensional display body formed of a fabric comprising metal-coated carbon fibers of diameter in the range of from about 4 μm to about 40 μm and length in the range of from about 1 mm to about 30 mm, and a composite material selected from the group consisting of:

(i) combustible activated carbon fibers having a BET surface area in the range of from about 250 to about 1,000 $m^2/g$, reinforced with a reinforcingly effective amount of non-ignitable binder fibers; and (ii) particulate combustible activated carbon of diameter in the range of from about 10 μm to about 500 μm encapsulated in a matrix of non-ignitable binder fibers, wherein said composite material comprises a metallic constituent as a metallic combustion catalyst to induce ignition and sustained combustion of said combustible activated carbon fibers (i) or particulate convertible activated carbon (ii), and the combustible activated carbon fibers (i) or particulate carbon (ii) constitutes at least 50% by weight, of the composite material, based on the total weight of said composite material, whereby said multi-dimensional display body's combustible activated carbon fibers (i) or particulate combustible activated carbon (ii) may be ignited and combusted by contact of said multi-dimensional display body with oxygen at ambient temperature.

19. A simulation decoy according to claim 18, wherein said composite material comprises combustible activated carbon fibers (i) which are coated with said combustion catalyst at a loading of from about ½% to about 5% by weight, based on the weight of said combustible activated carbon fibers, and wherein said combustible activated carbon fibers comprise from about 10% to about 40% by weight of fibers having a length of from about 0.01 inch to about 0.25 inch, based on the weight of said composite material.

20. A simulation decoy according to claim 19, wherein said combustible activated carbon fibers are present in said composite material with a reinforcingly effective amount of a non-ignitable carbon binder fiber having a BET surface area of less than 250 $m^2/g$.

21. A simulation decoy according to claim 18, wherein said multi-dimensional display body is in the form of a laminate structure, wherein the laminae of said laminate are impregnated with said combustible activated carbon fibers (1) or particulate combustible activated carbon (ii) such that said multi-dimensional display body provides a three-dimensional infrared signature.

22. A simulation decoy according to claim 21, wherein said infrared signature is in the geometric shape of a motive structure selected from the group consisting of land-based vehicles, marine vehicles, and aircraft.

* * * * *